United States Patent [19]

Kitamura

[11] Patent Number: 4,989,663

[45] Date of Patent: Feb. 5, 1991

[54] CASTING APPARATUS

[75] Inventor: Hiroshi Kitamura, Zama, Japan

[73] Assignee: Toshiba Kikai Kabushiki Kaisha, Tokyo, Japan

[21] Appl. No.: 338,199

[22] Filed: Apr. 14, 1989

[51] Int. Cl.[5] ..... B22D 17/30

[52] U.S. Cl. ..... 164/312; 164/316; 164/318

[58] Field of Search ..... 164/303, 306, 309, 312, 164/313, 314, 315, 316, 317, 318, 113

[56] References Cited

U.S. PATENT DOCUMENTS

| | | | |
|---|---|---|---|
| 4,789,020 | 12/1988 | Motomura | 164/312 |
| 4,850,420 | 7/1989 | Koya | 164/316 |

FOREIGN PATENT DOCUMENTS

| | | | |
|---|---|---|---|
| 55-100864 | 8/1980 | Japan | 164/309 |
| 62-279063 | 12/1987 | Japan | 164/312 |
| 62-286659 | 12/1987 | Japan | 164/312 |
| 63-34559 | 3/1988 | Japan . | |
| 63-66558 | 5/1988 | Japan . | |
| 63-106560 | 7/1988 | Japan . | |
| 63-106563 | 7/1988 | Japan . | |

*Primary Examiner*—Richard K. Seidel

*Attorney, Agent, or Firm*—Banner, Birch, McKie & Beckett

[57] ABSTRACT

A casting apparatus comprising a crucible furnace for containing a molten metal, a die assembly defining a die cavity having a casting volume for producing a die casting by forcing molten metal from the crucible furnace thereinto, an injection sleeve having a feed slot located therein, wherein the injection sleeve is vertically oriented for supplying the molten metal upwardly towards the die cavity, a feed block proximate to the injection sleeve and comprising a curved passage therein one end of which communicates with the feed slot, a feed pipe connected to the other end of the curved passage for providing fluid communication between the crucible furnace and the curved passage, feeder means for feeding the molten metal from the crucible furnace, through the feed pipe and the curved passage in the feed block, and through the feed slot into the injection sleeve. The present invention avoids the problems usually associated with the use of vertically oriented injection sleeve, such as oxidation of the molten metal, and solidification of molten metal upon the walls of the feed passage between the crucible furnace and the injection sleeve.

13 Claims, 4 Drawing Sheets

CASTING APPARATUS

BACKGROUND OF THE INVENTION

The present invention relates to a casting apparatus and more particularly to a casting apparatus for die casting machines which are capable of feeding molten metal efficiently into a vertically oriented injection sleeve for supplying the molten metal to a die casting chamber. The present invention reduces the problems associated with oxidation of the molten metal during the casting operation and ensures that accurate dosages of molten metal are delivered to the casting chamber at all times in order to yield high quality castings free of defects.

Casting apparatus have widely been used for obtaining a large quantity of desired cast products by supplying molten metal into a die cavity of a given shape and allowing the metal to solidify in the die cavity. Casting apparatus can roughly be classified as hot chamber and cold chamber casting apparatus.

One known type of cold chamber die casting machine is illustrated in FIG. 1 of the accompanying drawings. A horizontally oriented injection sleeve 11 is disposed in a fixed die plate 12 somewhat below its center. The injection sleeve has a feed slot 13 defined centrally in a lower wall portion inserted in the fixed die plate 12. The fixed die plate 12 has an L-shaped pipe hole 14 defined therein beneath the feed slot 13 and in communication therewith. A feed pipe 15 for feeding molten metal into the injection sleeve 11 has one end extending into the pipe hole 14 and coupled to the feed slot 13.

The other end of the feed pipe 15 is joined to a lower portion of a crucible furnace 16 which stores molten metal 17 and keeps the same at a prescribed temperature. An electromagnetic pump 18 is disposed on the feed pipe 15 for feeding the molten metal 17 from the crucible furnace 18 into the injection sleeve 11 and through the feed slot 13. The crucible furnace 16 has a heater 19 for keeping the molten metal 17 in the crucible furnace 16 at a prescribed temperature.

A die cavity 20 is defined by and between a fixed die 21 and a movable die 22. A sensor 23, such as a temperature sensor, may be disposed at the lower end of the die cavity 20 which communicates with the injection sleeve 11 through a runner 24. When a sufficient amount of molten metal is charged in the injection sleeve 11, the sensor 23 contacts the charged molten metal and detects that the dosage supplied to the injection sleeve is enough, i.e. that the injection sleeve is 100% full.

A frame 25 is connected to an outer side surface of the fixed die plate 12 and secured by bolts 26 and tie bars 27 to a movable die plate 28. A rod 29 connected to a coupling 30 and holding an injection plunger tip 31 is connected to the shaft 32 of a hydraulically operated cylinder 33.

Operation of the casting apparatus shown in FIG. 1 shall now be described. The molten metal 17 stored in the crucible furnace 16 is heated and kept at a desired temperature by energizing the heater 19. At this time, the injection plunger tip 31 is retracted to the illustrated position by an injection cylinder 33. The electromagnetic pump 18 is now energized to feed the molten metal 17 from the crucible furnace 16 through the feed pipe 15 and into the injection sleeve 11. The electromagnetic pump 18 is energized to charge the molten metal 17 into the injection sleeve 11 until a desired amount of molten metal 17 is contained in the injection sleeve 11, whereupon it is detected by the sensor 23. The sensor 23 can then generate a signal to a control unit (not shown) for instructing the electromagnetic pump to stop feeding molten metal 17 into the injection sleeve 11.

Then, the injection cylinder 33 is operated for advancing the piston rod 29 thereof at a prescribed speed to cause the injection plunger tip 31 to move forwardly at the same speed. Thus, the molten metal 17 charged in the injection sleeve 11 is forced by the plunger tip 31 through the runner 24 and into the die cavity 20. The molten metal in the die cavity 20 is allowed to cool and solidify. After the metal in the die cavity 20 has become solidified, the injection cylinder 33 is actuated to retract the plunger tip 31 away from the die cavity 20, whereupon the movable and fixed dies 21,22 can be separated and the finished casting product can be removed from the die cavity 20.

With the above arrangement, good performance and quality of finished castings can be achieved when the injection sleeve 11 is horizontally disposed as shown in FIG. 1. However, it sometimes is necessary that the injection sleeve should be vertically oriented for supplying molten metal upwardly to a die cavity situated above the injection sleeve. Conventional arrangements for supplying molten metal upwardly to a die cavity through a vertically oriented injection sleeve are described in FIGS. 2 and 3.

FIG. 2 illustrates a vertically oriented injection sleeve 34 having a vertically oriented rod 35 and plunger tip 36 located therein for forcing molten metal upwardly to a die assembly (not shown). The injection sleeve 34 includes a feed slot 37 near the lower end thereof for providing a passage for the molten metal 17 into the injection sleeve. the feed slot 37 communicates with a feed pipe 38 through a feed block 39. The other end of the feed pipe 38 is connected to the outlet of a crucible furnace 16 containing molten metal 17 heated to a prescribed temperature.

The feed pipe 38, which is in the shape of a crank, provides a fluid passage for the molten metal 17 from the crucible furnace 16 to the feed block 39 and into the injection sleeve 34 through the feed sot 37. The molten metal is advanced through the feed pipe 38 using an electromagnetic pump 18. A heating coil 40 is also provided on the upper portion of the crank-shaped feed pipe 38 nearest the feed block 39 for keeping the metal in its molten state, since this area is remote from the crucible furnace.

The conventional arrangement, as shown in FIG. 2, suffers from the following disadvantages:

First, when the magnetic pump is activated for filling molten metal into the injection sleeve 39, particularly as the molten metal first enters the injection sleeve 39 in the area of the feed slot 37, a significant air space 41 will be developed above the molten metal 17 inside the upper portion of the crank-shaped feed pipe 38. Such an air space 41 will remain in the feed pipe at least until the molten metal 17 is filled into the injection sleeve 34 just above the uppermost area of the feed slot 37. Due to the horizontal orientation of the upper section of the crank-shaped feed pipe 38, a large area on the surface of the molten metal 17 is exposed to air. Such a large surface area S is therefore easily subjected to oxidation by the air in the feed pipe 38, resulting in inferior castings.

Secondly, as the molten metal 17 enters into the injection sleeve 34 through the feed slot 37, there is a tendency for undulation and waves to develop upon the surface S of the molten metal 17. Such waves W can swell up and trap air within the molten metal 17. If such trapped air becomes introduced into the die cavity, inferior castings, having air cavities and blow holes therein, will be produced.

Thirdly, also as a result of the horizontal orientation of the upper portion of the crank-shaped feed pipe 38, when the plunger tip is raised above the feed slot, as shown by the dashed lines in FIG. 2, any remaining molten metal inside the upper portion of the feed pipe 38 will spill out through the feed slot and fall down through the bottom space in the injection sleeve 34 beneath the plunger tip 36. Such spilled molten metal can then collect and solidify upon other portions of the casting apparatus located beneath the injection sleeve 34, for example, upon the cylinder (not shown) which actuates the rod 35 of the plunger tip 36. Such spilled and solidified metal therefore creates a nuisance which can degrade the performance of the casting apparatus.

Finally, since the crank-shaped feed pipe 38 occupies a significant area between the crucible furnace 16 and the feed block 39, and since the feed pipe 38 is exposed to ambient air within this region, it is necessary to provide a heating coil 40 for keeping the metal in its molten state, particularly in the upper portion of the crank-shaped feed pipe 38. However, even when using such a heating coil 40, it is difficult to adequately maintain all of the metal in its molten state within the entire volume of the feed pipe 38. More specifically, the molten metal within the feed pipe 38 has a tendency to solidify on the inside walls of the feed pipe 38 and feed block 39, particularly within the corners of the bent portions of the crank-shaped feed pipe 38 and also within the feed block 39, since these areas are remote from the effective area of the heating coil 40. The solidified metal thus reduces the effective volume of the feed pipe 38 and feed block 39. Since the dosage of molten metal supplied to the injection sleeve is typically controlled dependent upon a known volume inside the feed pipe 38, such reductions in volume within the feed pipe 38 and feed block 39 create problems for accurately controlling the amount of molten metal supplied to the injection sleeve 34. Furthermore, if a portion of the molten metal intended for delivery to the injection sleeve becomes solidified on the walls of the feed pipe during transit between the crucible furnace 16 and the injection sleeve 34, a diminished amount of molten metal will actually be supplied to the feed pipe 38 and die assembly 42, thus resulting in yet another source of error in controlling the dosage of molten metal supplied to the injection sleeve 34 and ultimately to the die cavity.

One attempt to remedy the problems associated with spillage of the molten metal through the bottom portion of the injection sleeve 34 is shown in FIG. 3. In FIG. 3, the same elements which have already been described in relation to the earlier figures shall be denoted by like reference numerals. In this known embodiment, the upper portion of the feed pipe 38 is inclined for providing a sloped passage for the molten metal through the upper portion of the feed pipe 38, through the feed block 39 and feed slot 37 and into the injection sleeve 34. The feed block 39 is also provided with an inclined passage 39*a* therein. Due to the inclination of the passage through the feed pipe 38 and feed block 39, there is less of a tendency for the molten metal to spill out of the feed passage and through the bottom end of the injection sleeve when the plunger tip 31 is advanced above the feed slot 37. Rather, most of the remaining molten metal in the upper area of the feed block 39 will simply flow back down the inclined passage of the feed block 39 and feed pipe 38 instead of spilling into the bottom end of the injection sleeve 34 through the feed slot 37. However, the arrangement shown in FIG. 3 still suffers from the problems of solidified metal adhering to the walls of the feed pipe 38 and feed block 39 and also from exposure of the surface of the molten metal to a large air space within the feed pipe 38, resulting in unwanted oxidation of the molten metal.

SUMMARY OF THE INVENTION

It is an object of the present invention to provide a casting apparatus which includes a crucible furnace for storing molten metal at a constant temperature, a vertically oriented injection sleeve coupled to the crucible furnace by a feed pipe, a feed mechanism such as an electromagnetic pump disposed on the feed pipe for feeding molten metal from the crucible furnace into the injection sleeve, and wherein the molten metal is supplied to the vertically oriented injection sleeve while avoiding the problems usually associated with the use of such vertically oriented injection sleeves, such as oxidation of the molten metal, and solidification of molten metal upon the walls of the feed passage between the crucible furnace and the injection sleeve.

According to the present invention, there is provided a casting apparatus comprising a crucible furnace for containing a molten metal, a die assembly defining a die cavity having a casting volume for producing a die casting by forcing molten metal from the crucible furnace thereinto, an injection sleeve having a feed slot located therein, wherein the injection sleeve is vertically oriented for supplying the molten metal upwardly towards the die cavity, a feed block proximately located next to the injection sleeve and comprising a curved passage therein one end of which communicates with the feed slot, a feed pipe connected to the other end of the curved passage for providing fluid communication between the crucible furnace and the curved passage, feeder means for feeding the molten metal from the crucible furnace, through the feed pipe and the curved passage in the feed block, and through the feed slot into the injection sleeve.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 4:
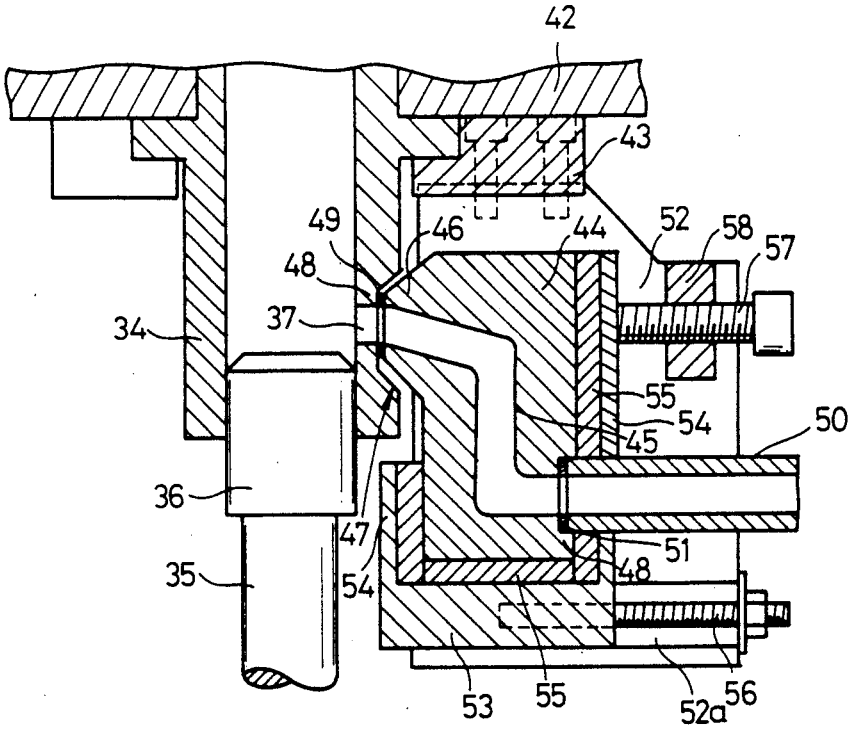
FIG. 4 is a partly cross-sectional view of a casting apparatus according to an embodiment of the present invention.
Figure 5:
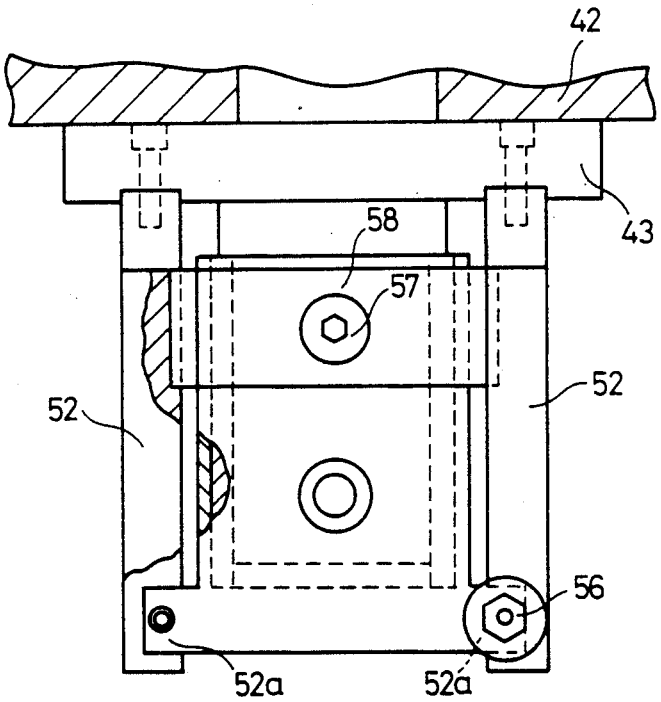
FIG. 5 is an end view of the casting apparatus of the present invention shown in FIG. 4.

Referring now to FIGS. 4 and 5, a casting apparatus according to an embodiment of the present invention will be described, wherein the same elements which have already been described in relation to the earlier figures shall be denoted by like reference numerals.

FIG. 4 shows a vertically oriented injection sleeve 34 secured to the lower surface of a die assembly 42 and connected thereto through a sleeve base 43. An injection plunger tip 36 and rod 35 are located within the injection sleeve 34 for forcing molten metal upwardly into a die assembly 42. The injection sleeve 35 also includes a feed slot 37 located near the lower portion thereof for introduction of molten metal from a crucible furnace (not shown).

Figure 1:
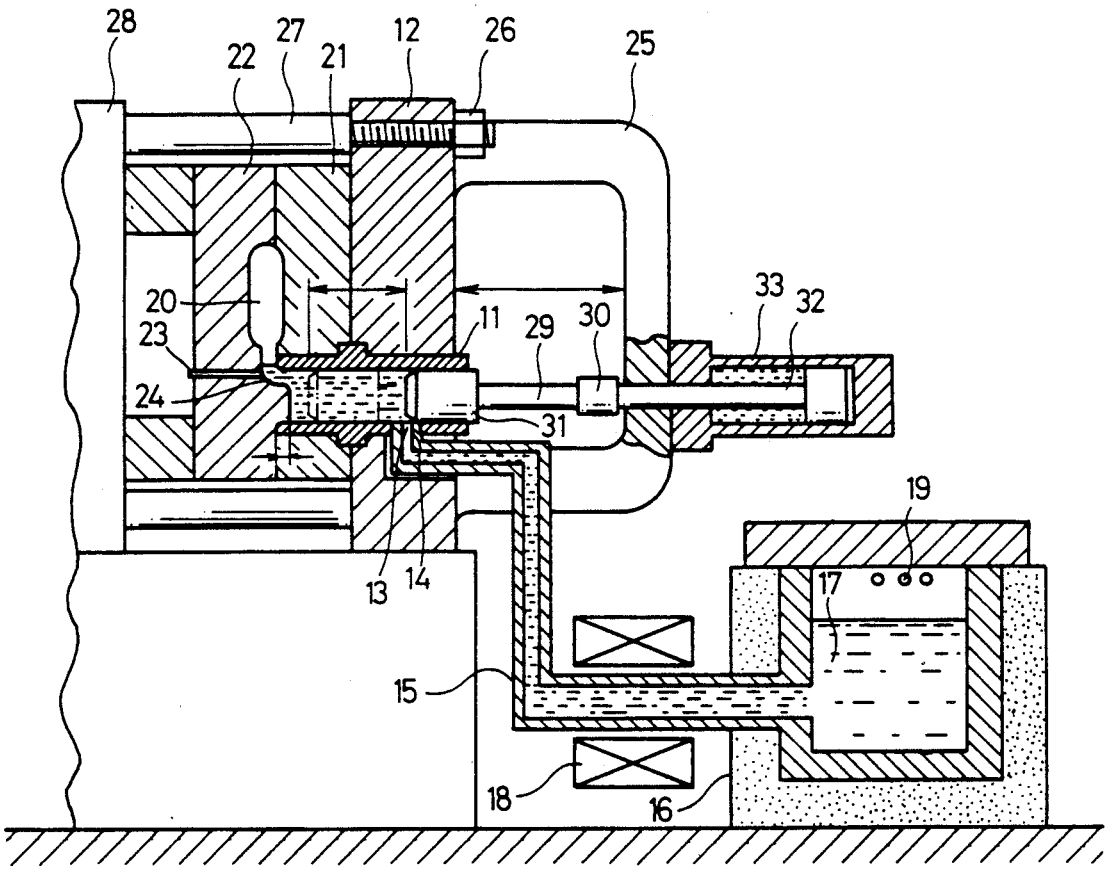
FIG.1 (Prior Art)
FIG. 1 is a partly cross-sectional view of a casting apparatus according to the prior art.
Figure 2:
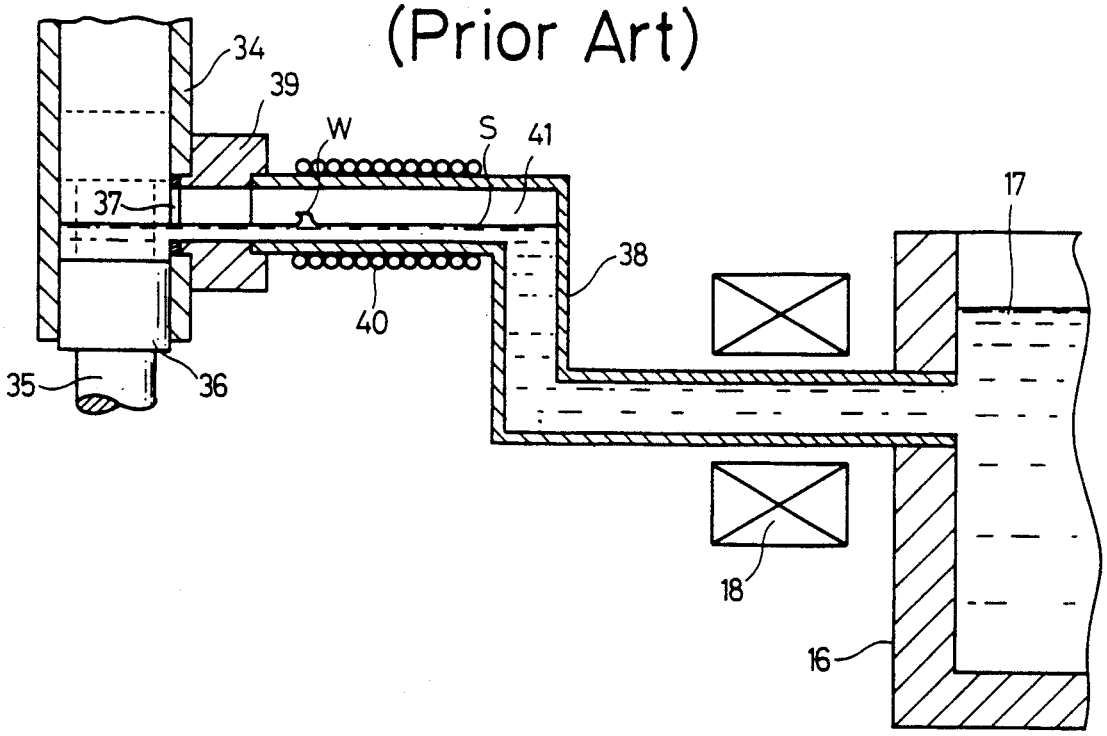
FIG.2 (Prior Art)
FIG. 2 is a partly cross-sectional view of a casting apparatus comprising a vertically oriented injection sleeve and showing the feed passage between a crucible furnace and the injection sleeve according the prior art.
Figure 3:
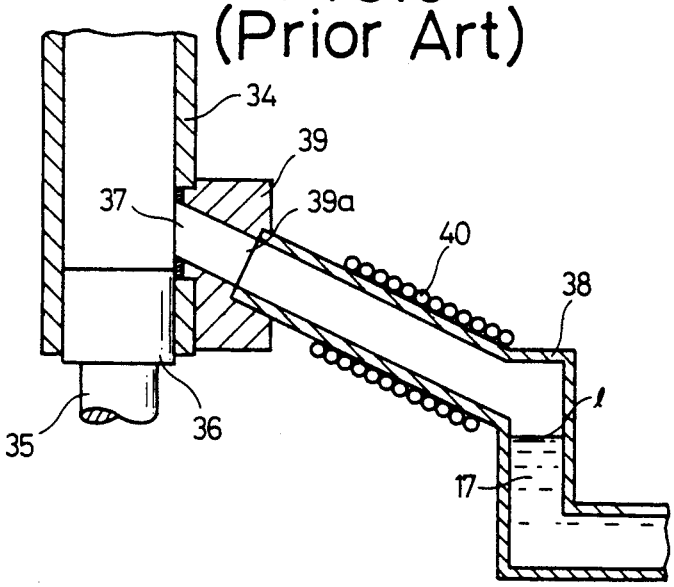
FIG.3 (Prior Art)
FIG. 3 is a partly cross-sectional view of a casting apparatus according to the prior art comprising a vertically oriented injection sleeve and showing the molten metal feed passage wherein an upper portion of the feed passage is inclined upwardly toward the injection sleeve.

Located adjacent to the feed slot 37 is a feed block 44 which embodies a significant feature of the present invention. The feed block 44 includes a curved fluid passage 45 located therein for passage of the molten metal through the feed slot 37 into the injection sleeve 34. The feed block 44 communicates with the feed slot 37 through a tapered coupling 46 which may preferably be in the shape of a truncated cone. More specifically, the injection sleeve 34 in the area of the feed slot 37 includes a concave recess therein, which may also be in the shape of a truncated cone for providing a complimentary fitting with the tapered coupling 46 of the feed block 44. The concave recess 47 includes a seat 48 for receiving a packing member 49. Such a packing member 49 serves the dual purpose of providing a fluid tight seal between the feed block 44 and the feed slot 37 as well as serving to insulate the injection sleeve 34 from any heat which may be transmitted from the feed block 44, as shall be described further below. The other end of the curved passage 45 remote from the feed slot 37 communicates with a feed pipe 50. The feed pipe 50, at its other end thereof (not shown) is connected to a source of molten metal in a crucible furnace. The molten metal is thus conveyed through the feed pipe 50, in accordance with known practices, by means of an electromagnetic pump 18 (FIG. 1). The feed pipe 50 is coupled to the feed block 44 through a seat 48 containing another packing member 51.

With further reference to FIGS. 4 and 5, a structure for mounting the feed block 44 adjacent to the injection sleeve will now be described. A mounting frame includes a pair of parallel holders 52 which are connected to the bottom of the sleeve base 43, for example through bolts, so that the holders 52 suspend downwardly from the sleeve base 43 flanking opposite sides of the feed block 44. Located intermediate the feed block and the base plate 53 and walls 54 are insulating plates 55. Accordingly, the feed block 44 is securely cradled within the cavity defined by the base plate 53 and walls 54 while being insulated by insulating plates 55. The base plate 53 is fitted into slot **52*a* and held within the same by means of lower bolts 56. When turned, the lower bolts 56 exert a pulling force on the base plate 53 and hence the feed block 44, at its bottom end, is pulled by the lower bolts 56 so that the curved passage 45 at the seat coupling 48 thereof is tightly pressed against the feed pipe 50 through the packing 51 for providing a fluid tight seal. At the same time, an upper bolt 57 is provided which extends through a clamp holder 58 in threaded engagement therewith and presses against the wall 54. When turned, the upper bolt pushes against the wall 54 so that the feed block 44, at its upper end thereof, is pushed toward the injection sleeve. Therefore, the tapered coupling 46 is tightly pressed against the concave recess 47 through the packing 49 for providing a fluid tight seal between the curved passage 45 and the feed slot 37**.

Figure 6:
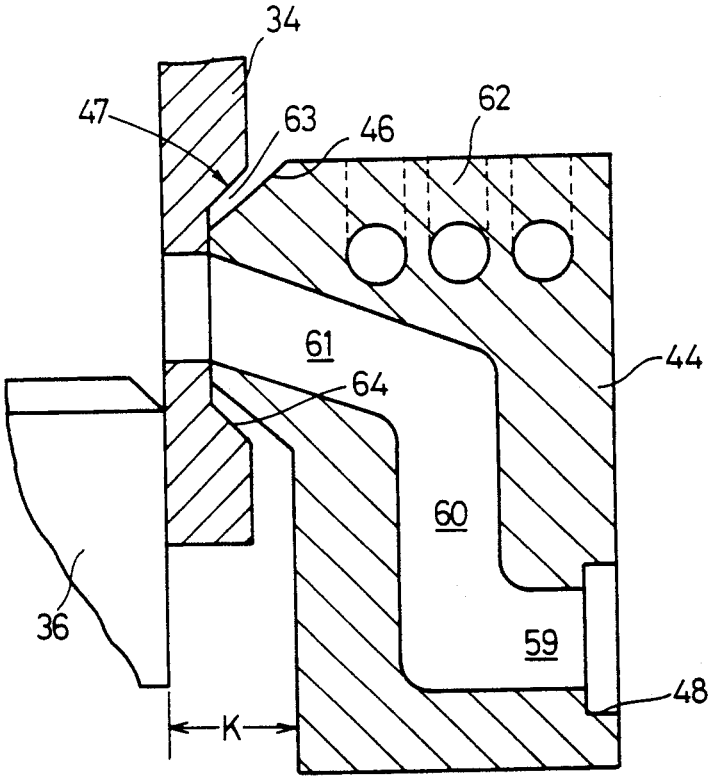
FIG. 6 is a fragmentary cross-sectional view of a casting apparatus showing in detail the heating block and curved passage according to the present invention.
Figure 7:
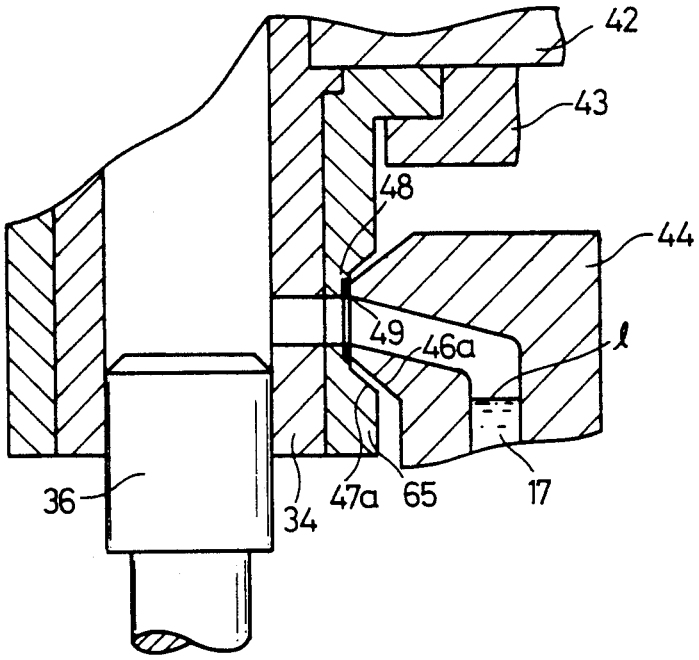
FIG. 7 is a fragmentary cross-section view of a casting apparatus showing in detail the injection sleeve according to another embodiment of the present invention.

FIG. 6 shows in detail the feed block 44 and tapered coupling 46 of the present invention. One requirement of the present invention is to provide a fluid passage for the molten metal which eliminates the problems associated with oxidation of the metal. Accordingly, the present invention provides a curved fluid passage 45 within the feed block 44. Such a passage 45 includes a first horizontal section 59, a vertical section 60, and an inclined section 61 sloping upwardly toward the feed slot 37. After injection of the molten metal upwardly into the die cavity, the molten metal remaining inside the curved passage 45 flows down the inclined portion 61 and tends to remain within the vertical portion 60 thereof as shown by the level line 1 (FIG. 7). The surface area of the molten metal exposed to air at the level line 1 is accordingly very small, essentially only an area equal to $\pi r^2$ wherein r is the radius of the vertical section 60 of the curved passage 45. Therefore, since only a small surface area of the molten metal is exposed to the air, any problems associated with oxidation of the molten metal are greatly reduced.

Another requirement for producing optimum quality of finished castings is that the molten metal should remain in its molten condition at all times within the curved passage of 45 of the feed block 44, so as to avoid the danger of metal becoming solidified and adhering to the walls within the curved passage 45. Accordingly, the feed block 44, which is preferably formed of a ceramic material, includes a heating means 62 located therein. Due to the good heat conducting properties of the ceramic material feed block 44, the heat from the heating means 62 becomes uniformly distributed throughout the feed block 44 so that the curved passage 45 can remain uniformly heated throughout. Accordingly, there is little tendency for the molten metal to solidify on the walls of the curved passage, as has been the problem with the use of crank-shaped feed pipes according to the prior art. In general, it is preferred that the feed block should be made from ceramic materials with good heat conductivity and which exhibit the property that the molten metal will not easily adhere thereto. However, it is sometimes necessary to form the feed block 44 from materials other than ceramics, such as steel, particularly when casting products from metals, such as molybdenum, which melt only at very high temperatures.

As noted, it is necessary that the feed block 44 be maintained at high temperatures, commonly in the range of 600° C. or higher. However, it is detrimental that the molten metal should remain at such elevated temperatures once transferred into the injection sleeve 34. Therefore, it is necessary to provide effective insulation between the feed block 44 and the injection sleeve 34. In the present invention, this is accomplished by means of the tapered coupling 46 and concave recess 47 associated with the feed block 44 and injection sleeve 34 respectively. As shown in FIG. 6, the feed block 44 is coupled to the injection sleeve through a tapered coupling 46 which may be in the shape of a truncated cone. The tapered coupling 46 is fitted within a concave recess 47 in the injection sleeve which may also comprise a conical recess in the shape of a truncated cone for providing a complimentary fitting with the tapered coupling 46. The coupling 46 and recess 47 are fitted together while allowing an air space 63 to remain therebetween, so that a space remains between the tapered walls of the coupling 46 and the walls 64 of the recess 47. Accordingly, only a small surface of the feed block actually abuts against the feed slot. Further, the bulk of the feed block 44 remains a significant distance K spaced away from the injection sleeve.

Since only a small area of the feed block 44 actually abuts against the injection sleeve 34 at the tapered coupling 46, the bulk of the feed block 44 therefore remains out of direct thermal contact with the injection sleeve 34. Accordingly, any transfer of heat between the feed block 44 and the injection sleeve 34 is effectively reduced. Furthermore, the air gap 63 between the tapered coupling 46 and recess 47 provides an additional effective layer of insulation between the feed block 44 and the injection sleeve 34, thus further preventing heat from being transferred therebetween. Finally, as already mentioned, a packing 49 (FIG. 4) is provided between the tapered coupling 46 and recess 47, which provides yet another important layer of insulation. Therefore, the injection sleeve 34 can remain effectively thermally insulated from the high heat produced by the heater 62 of the feed block 44.

FIG. 7 shows in detail a second embodiment of the present invention for providing an additional layer of insulation between the feed block 44 and the injection sleeve 34. If desired, the injection sleeve 34 can include a sleeve guide 65 associated therewith and fitted concentrically around the injection sleeve 34. In this embodiment, the sleeve guide 65, and not the injection sleeve itself, includes a recess 47*a* for receiving the tapered coupling 46 of the feed block 44. Accordingly, the sleeve guide 65 can provide another layer of insulation between the feed block and the injection sleeve, since the injection sleeve 34 itself is kept out of direct thermal contact with the feed block 44.

Operation and further advantages of the present invention shall now be described. Molten metal is heated and maintained at a prescribed temperature inside a crucible furnace 16. The molten metal is conveyed to the die assembly through the feed pipe 50 by a feed means such as an electromagnetic pump 18. The molten metal therefore travels through the feed pipe 50 and enters the curved passage 45 of the feed block 44. At this time, the piston rod 35 is retracted and a prescribed amount of metal is supplied to the injection sleeve 34 through the feed slot 37. After the prescribed amount of metal has been supplied to the injection sleeve 34, the rod is actuated for moving the plunger 36 upwardly for forcing molten metal into the die assembly 42.

Due to the curved path 45 within the feed block 44, the length of the feed path can be relatively short. Accordingly, the molten metal can be maintained in a melted condition throughout the length of the feed path. Also, the volume within the curved passage 45 is small and therefore the surface area of the molten metal in the curved path which is exposed to air is minimized. Accordingly, problems associated with oxidation of the molten metal in the feed path are reduced. More particularly, between the shots of molten metal supplied to the injection sleeve 34, any molten metal remaining within the curved passage will flow back down the inclined upper portion 61 thereof. Thus, any spillage of the molten metal through the bottom end of the injection sleeve is avoided while also assuring that only a small surface area of the molten metal is exposed to air within the curved passage 45.

The molten metal within the feed block 44 is uniformly heated by the heating means 62. Since the feed block may be formed from ceramic materials, the metal within the curved path 45 remains uniformly heated at a high temperature so that any solidification of the molten metal on the walls of the curved passage 45 is avoided. At the same time, any unwanted transfer of heat between the feed block 44 and the injection sleeve 34 can be avoided due to the tapered fitting 46 and recess 47 and the air space 63 formed thereby, thus providing effective insulation between the feed block 44 and the injection sleeve 34.

Although certain preferred embodiments have been shown and described, it should be understood that many changes and modifications may be made therein without departing from the scope of the appended claims.

I claim:

1. A casting apparatus comprising: a crucible furnace for containing a molten metal, a die assembly defining a die cavity having a casting volume for producing a die casting by forcing molten metal from said crucible furnace thereinto, an injection sleeve having a feed slot located therein, wherein said injection sleeve is vertically oriented and includes a vertically oriented ram for supplying said molten metal upwardly into said die cavity, a feed block proximate to said injection sleeve and comprising a curved passage therein one end of which communicates with said feed slot, a feed pipe connected to the other end of said curved passage for providing fluid communication between said crucible furnace and said curved passage, feeder means for feeding the molten metal from said crucible furnace, wherein said molten metal is fed from said crucible furnace, through said feed pipe, said curved passage and said feed slot into said injection sleeve.

2. A casting apparatus according to claim 1, further comprising heat insulation means between said feed block and said injection sleeve for preventing heat from being transferred between said feed block and said injection sleeve.

3. A casting apparatus according to claim 2, wherein said feed block includes a tapered coupling located at an outlet of said curved passage, and said injection sleeve comprises a recess located at said feed slot thereof for receiving said tapered coupling for providing a fluid communication between said curved passage and said feed slot.

4. A casting apparatus according to claim 3, wherein said heat insulation means comprises an air space defined between said tapered coupling and said recess.

5. A casting apparatus according to claim 2, further comprising a sleeve guide located concentrically around said injection sleeve.

6. A casting apparatus according to claim 5, wherein said feed block includes a tapered coupling located at the outlet of said curved passage, and said sleeve guide comprises a recess located proximate to said feed slot for receiving said tapered coupling for providing fluid communication between said curved passage and said feed slot.

7. A casting apparatus according to claim 6, wherein said heat insulation means comprises an air space defined between said tapered coupling and said recess.

8. A casting apparatus according to claim 3 or 6, wherein said tapered coupling comprises a truncated cone.

9. A casting apparatus according to claim 8, wherein said recess comprises a concave truncated cone for receiving said tapered coupling.

10. A casting apparatus according to claim 1, further comprising a heating means associated with said feed block for heating and maintaining said feed block at a prescribed temperature.

11. A casting apparatus according to claim 1, further comprising a pair of holder members and having grooves located at the lower portions of each said holder member, wherein said feed block is supported upon a base plate between said holder members, said base plate being inserted within said grooves.

12. A casting apparatus according to claim 11, further comprising a clamp holder supported in an upper portion between said holder members, and including an upper bolt threadedly engaged in said clamp holder for pushing the feed block toward said injection sleeve.

13. A casting apparatus according to claim 12, further comprising lower bolts located in said grooves and threadedly engaging said base plate for pulling a lower portion of said feed block away from said injection sleeve and toward said feed pipe.

* * * * *